US007040825B2

(12) United States Patent
Asada et al.

(10) Patent No.: US 7,040,825 B2
(45) Date of Patent: May 9, 2006

(54) IMAGE FORMING APPARATUS AND SUCTION TYPE PLATEN USED IN THE SAME

(75) Inventors: Tetsuo Asada, Kuwana (JP); Toshio Sugiura, Anjo (JP); Nobuo Hiraki, Nagoya (JP); Kan Ishikawa, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/808,337

(22) Filed: Mar. 25, 2004

(65) Prior Publication Data

US 2004/0245700 A1 Dec. 9, 2004

(30) Foreign Application Priority Data

Mar. 28, 2003 (JP) ..... 2003-089932

(51) Int. Cl.
*B41J 11/02* (2006.01)
*B41J 2/01* (2006.01)

(52) U.S. Cl. ..... 400/656; 400/648; 347/104

(58) Field of Classification Search ..... 347/104, 347/220; 400/23, 48, 648, 656
See application file for complete search history.

(56) References Cited

U.S. PATENT DOCUMENTS 6,736,501 B1 * 5/2004 Yamaguchi et al. ..... 347/104
2002/0167578 A1 * 11/2002 Miki et al. ..... 347/104
2004/0066445 A1 * 4/2004 Bruhn ..... 347/104

FOREIGN PATENT DOCUMENTS

JP A 5-77997 3/1993

* cited by examiner

*Primary Examiner*—Daniel J. Colilla
(74) *Attorney, Agent, or Firm*—Oliff & Berridge, PLC

(57) ABSTRACT

An image forming apparatus includes an image forming unit, a platen, a feeding device, and a suction device. The paper carrier includes first protrusions, recesses, second protrusions, and two suction ports in each recesses. The first protrusions extend in parallel with a feed direction and are arranged at predetermined intervals in a direction perpendicular to the feed direction. The recesses are defined between adjacent ones of the first protrusions and extend in the feed direction. The second protrusions are provided on downstream and upstream sides, respectively, in the feed direction with respect to an image forming region and extend in the direction perpendicular to the feed direction. The two suction ports are defined on the downstream and upstream sides, respectively, in the feed direction with respect to the image forming region in each of the recesses. The suction ports communicate with the suction device.

43 Claims, 15 Drawing Sheets

IMAGE FORMING APPARATUS AND SUCTION TYPE PLATEN USED IN THE SAME

BACKGROUND OF THE INVENTION

1. Field of the Invention

The present invention relates to an image forming apparatus including an image forming unit such as an ink jet recording head for forming an image on a sheet of paper, and a platen disposed to face the image forming unit.

2. Description of the Related Art

In an apparatus which ejects ink from nozzles of an ink jet recording head and adheres the ink onto a sheet of paper to form an image on the sheet of paper, a platen is disposed to face a nozzle surface of the recording head, a pair of upstream feed rollers on a feed upstream side (hereinafter merely called "upstream side") and a pair of downstream feed rollers on a feed downstream side (hereinafter merely called "downstream side") are disposed so that the platen is put between the pair of upstream feed rollers and the pair of down stream feed rollers. While the two pairs of rollers nip the sheet of paper, the two pairs of rollers are driven intermittently to move (stepwise) the sheet of paper intermittently in a sub-scanning direction. On the other hand, when the intermittent movement is stopped, a carriage equipped with the recording head is moved in a main scanning direction so that images of predetermined sections are one-by-one formed on the sheet of paper supported by the platen.

Incidentally, when ink of the ink jet recording head is put on the sheet of paper, the sheet of paper may be expanded so that cockling of the sheet of paper occurs between the pair of upstream feed rollers and the pair of downstream feed rollers to bring a surface of the sheet of paper into contact with the nozzle surface. As a result, the recorded image is stained with unnecessary ink to reduce image quality. On the other hand, when the sheet of paper curls intensively before the forward end of the sheet of paper to be fed is nipped by the pair of downstream feed rollers or just after the rear end of the sheet of paper is escaped from the pair of upstream feed rollers, the front or rear end edge of the sheet of paper collides with the nozzle surface and rubs against the nozzle surface. As a result, there is fear that the sheet of paper may be stained badly or the recording head may be damaged.

To solve this problem, for example, JP-A-Hei.5-77997 has disclosed the following technique. That is, suction ports are formed in a surface of the platen so as to communicate with a suction unit such as a suction fan. A current of air is generated so that the sheet of paper is sucked onto the surface of the platen to thereby prevent the sheet of paper from coming into contact with the nozzle surface.

SUMMARY OF THE INVENTION

In the configuration of JP-A-Hei.5-77997, however, the portion of contact between the sheet of paper and the platen is planar. Accordingly, there is a problem that a heavy feed load is caused by frictional force between the sheet of paper and the platen.

The invention is developed to solve the problem in the background art. Disclosed herewith are a platen in which such a heavy feed load can be prevented while a current of air can be generated continuously, and an image forming apparatus including the platen.

According to an embodiment of the invention, an image forming apparatus includes an image forming unit which forms an image on one surface of a printing medium, a platen, a feeding device which transports the printing medium in a feed direction along the platen while the other surface of the printing medium faces a surface of the platen, and a suction device which sucks air. The platen includes first protrusions, recesses, second protrusions, and suction ports in each recess. The first protrusions protrude from the surface of the platen and extend in parallel with the feed direction and are arranged at predetermined intervals in a direction perpendicular to the feed direction. The recesses are defined between adjacent ones of the first protrusions and extend in the feed direction. The second protrusions protrude from the surface of the platen and are provided on downstream and upstream sides, respectively, in the feed direction with respect to an image forming region where the image forming unit forms an image, and extend in the direction perpendicular to the feed direction. The suction ports are defined on both the downstream and upstream sides, respectively, in the feed direction with respect to the image forming region in each of recesses surrounded by the adjacent ones of the first protrusions and the second protrusions on the upstream side and the downstream side, and communicate with the suction device.

According to the embodiment of the invention, an image forming apparatus includes an image forming unit which forms an image on one surface of a printing medium, a platen, a feeding device which transports the printing medium in a feed direction along the platen while the other surface of the printing medium faces a surface of the platen, and a suction device which sucks air. The platen includes first projections, recesses, second projections, suction ports. The first protrusions protrude from the surface of the platen and extend in parallel with the feed direction and are arranged at predetermined intervals in a direction perpendicular to the feed direction. The recesses are defined between adjacent ones of the first protrusions and extend in the feed direction. The second protrusions protrude from the surface of the platen and are provided on downstream and upstream sides, respectively, in the feed direction with respect to an image forming region where the image forming unit forms an image, and extend in the direction perpendicular to the feed direction. The suction ports are defined in a predetermined region in the vicinity of the second projections and inside the second protrusions, and communicate with the suction device. At least part of the second projections on the upstream side and the second projections on the downstream side are disposed in two rows in a staggered configuration.

According to the embodiment of the invention, an image forming apparatus includes an image forming unit which forms an image on one surface of a printing medium, a platen, a feeding device which transports the printing medium in a feed direction along the platen while the other surface of the printing medium faces a surface of the platen, and a suction device which sucks air. The platen includes first projections, recesses, second projections, and suction ports. The first protrusions protrude from the surface of the platen and extend in parallel with the feed direction and are arranged at predetermined intervals in a direction perpendicular to the feed direction. The recesses are defined between adjacent ones of the first protrusions and extend in the feed direction. The second protrusions protrude from the surface of the platen and are provided on at least one of upstream side and down side in the feed direction with respect to an image forming region where the image forming unit forms an image, and extend in the direction perpendicular to the feed direction. The suction ports are defined in a predetermined region of at least one of the recesses in the vicinity of the second projections and in another region of at least one of the recesses distant from the predetermined region in the feed direction, are defined inside the second protrusions, and communicate with the suction device.

According to the embodiments of the invention, an image forming apparatus includes an image forming unit which forms an image on one surface of a printing medium, a platen, a feeding device which transports the printing medium in a feed direction along the platen while the other surface of the printing medium faces a surface of the platen, and a suction device which sucks air. The platen includes a plurality of paper receiving surfaces, recesses, estrange portions, and suction ports. The paper receiving surfaces are provided on the surface of the platen and extend in parallel with the feed direction and are provided at predetermined intervals in a direction perpendicular to the feed direction. The recesses are defined between adjacent ones of the paper receiving surfaces and extend in the feed direction. The estrange portions are provided on one of upstream side and downstream side of at least a part of the recesses in the feed direction and estrange the printing medium and the recesses. The suction ports are defined on the other of the upstream side and the downstream side in the feed direction and communicate with the suction device.

According to the embodiment of the invention, a platen includes a plurality of paper receiving surfaces, recesses, estrange portions, and suction ports. The plurality of paper receiving surfaces are provided on a surface of the platen and extend in parallel with a predetermined direction and are provided at predetermined intervals in a direction perpendicular to the predetermined direction. The recesses are defined between adjacent ones of the paper receiving surfaces and extend in the predetermined direction. The estrange portions are provided on at least one of upstream side and downstream side of at least a part of the recesses in the predetermined direction and estrange the printing medium and the recesses. The suction ports are defined on at least one of the upstream side and the downstream side in the feed direction and on a surface of at least a part of the recesses.

DETAILED DESCRIPTION OF THE PREFERRED EMBODIMENTS

An embodiment of the invention will be described below. This embodiment of the invention is applied to a printer 1 which includes a print portion 3 using an ink jet recording head 2.

Figure 1:
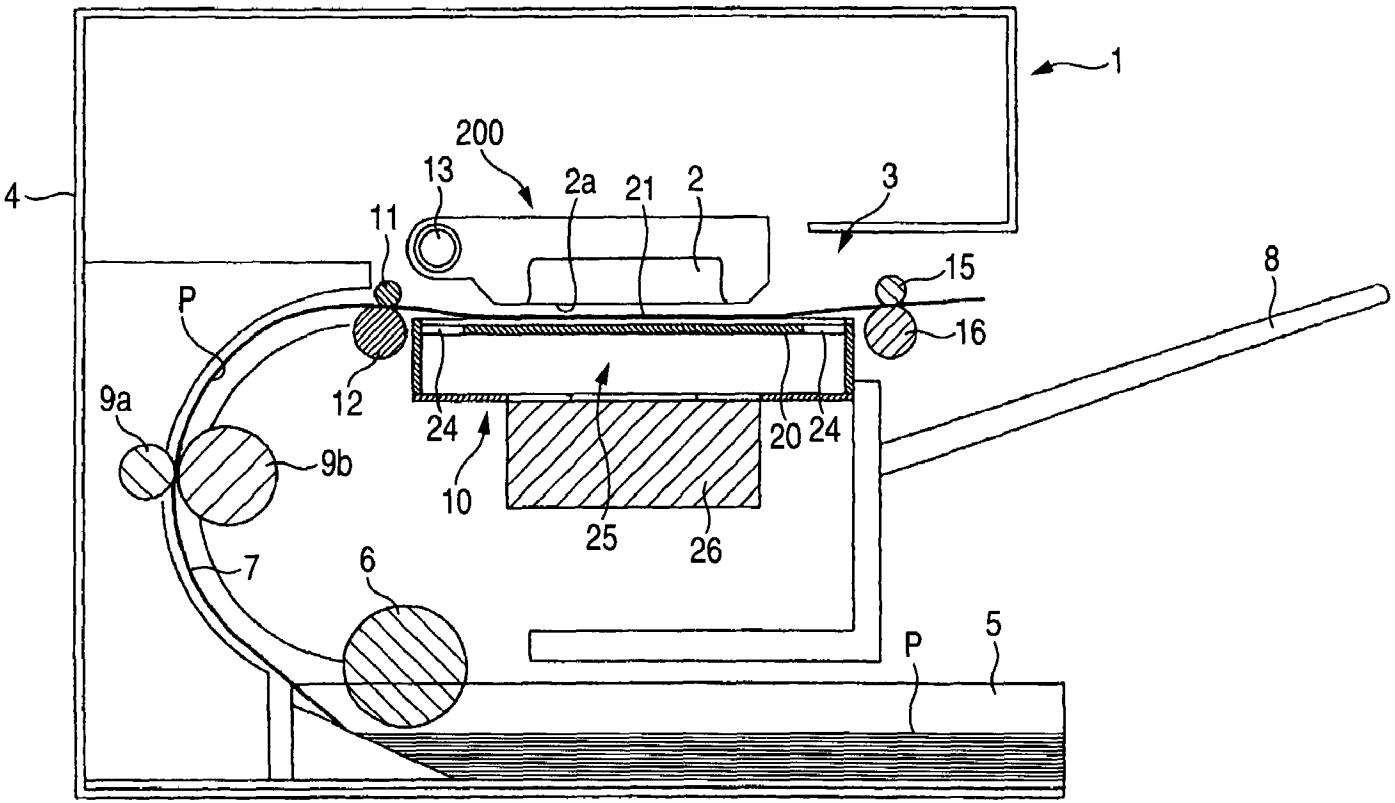
FIG. 1 is a schematic sectional view of a printer.

As shown in FIG. 1, a paper tray 5 is set in a lower portion of a body housing 4 of the printer 1 so that the paper tray 5 can be pulled out of the body housing 4. A paper table (not shown), which is urged upward and on which sheets of paper P are stacked, is put in the paper tray 5. A paper supply roller 6 disposed on a starting end side of an upper surface of the paper tray 5 rotates to separate the stacked sheets of paper P so that the stacked sheets of paper P are one by one fed toward the print portion 3 through a pair of feed rollers 9*a* and 9*b* in the middle of a feed path 7. A paper outlet tray 8 for receiving the sheets of paper P after formation of images in the print portion 3 protrudes horizontally from an opening portion on a side of the body housing 4.

Incidentally, an operation panel portion (not shown) which has a numeric keypad used for executing a printer operation, a button keypad for issuing various operating commands, a liquid crystal panel, etc. is disposed, for example, on an upper surface of the body housing 4.

The print portion 3 includes: a suction type platen 10, which will be described later in detail; a pair of upstream feed rollers 11 and 12 disposed just upstream of the platen 10; and a pair of downstream feed rollers 15 and 16 disposed just downstream of the platen 10. An ink jet recording head 2 is provided so that a nozzle surface 2*a* of the recording head 2 faces the upper surface of the platen 10, which will be described later in detail. The recording head 2 is mounted on a carriage 200, which can move backward and forward along a pair of left and right long guide shafts 13 (only one of which is shown in FIG. 1). An ink cartridge (not shown) in which various color types of ink such as cyan, yellow, magenta and black are stored is detachably attached onto the upper surface of the color ink jet cartridge type recording head 2.

The moving direction of the recording head 2 is hereinafter referred to as "main scanning direction". A direction perpendicular to the main scanning direction is hereinafter referred to as "sub-scanning direction", "paper feed direction" or simply "feed direction" (the same thing will apply hereinafter).

Figure 2:
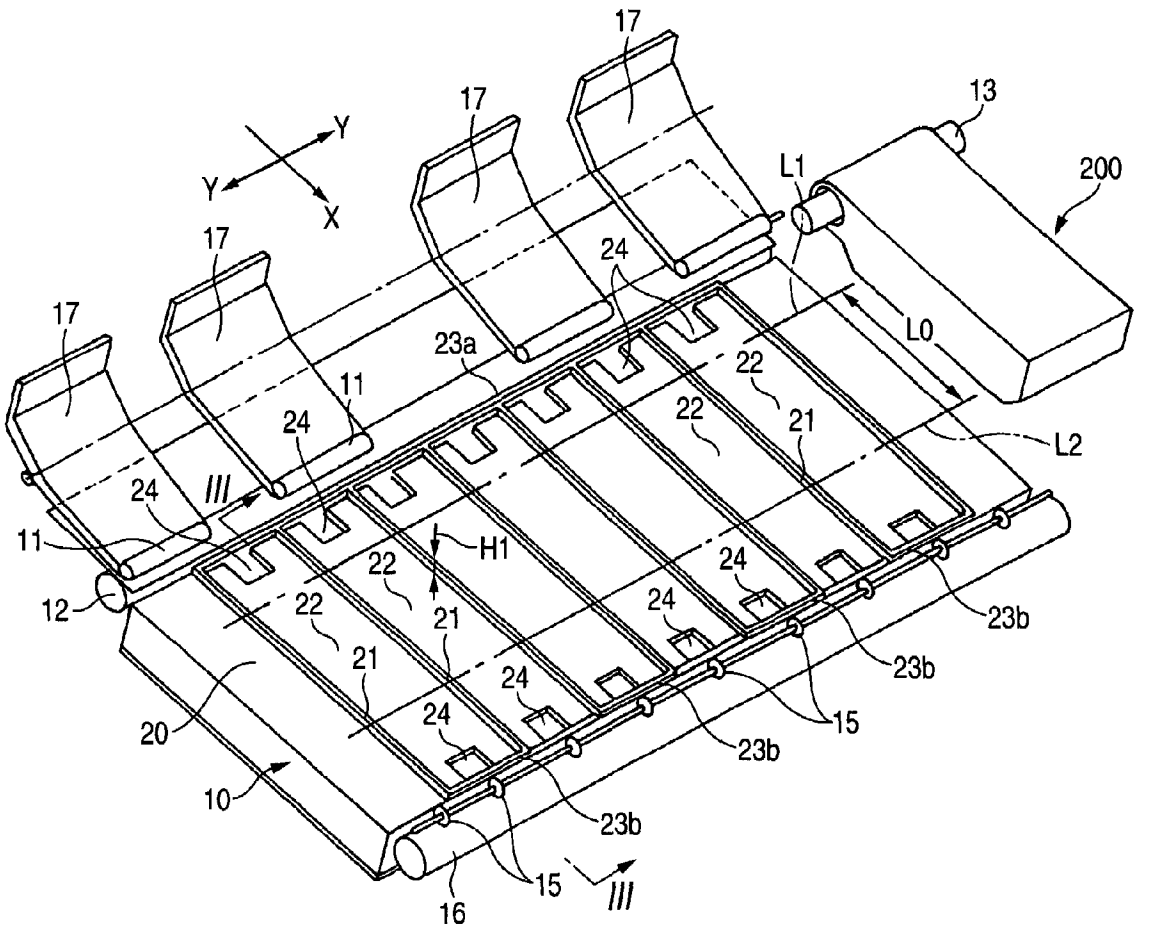
FIG. 2 is a perspective view showing a platen according to a first embodiment of the invention.

The drive roller 16, which is one of the pair of downstream feed rollers and is disposed on the lower side, is a single roller extending long in the main scanning direction. The driven roller 15, which is the other of the pair of downstream feed rollers and is disposed on the upper side, is provided with spurs arranged at regular intervals in the main scanning direction as shown in FIG. 2.

The drive roller 12, which is one of the pair of upstream feed rollers and is disposed on the lower side, is a single roller extending long in the main scanning direction. The driven roller 11, which is the other of the pair of upstream feed rollers and is disposed on the upper side, includes a plurality of driven roller parts 11 rotatably supported at end portions of arms 17, respectively, as shown in FIG. 2. The driven roller parts 11 and the arms 17 are arranged at regular intervals in the main scanning direction. The arms 17 are pivoted on a support shaft extending in the main scanning direction so that the arms 17 can rotate up and down. The upstream drive roller 12 and the downstream drive roller 16 are synchronized with each other through a carrying motor and a transmission gearing mechanism (both not shown) so that they can rotate intermittently in one direction.

Figure 3:
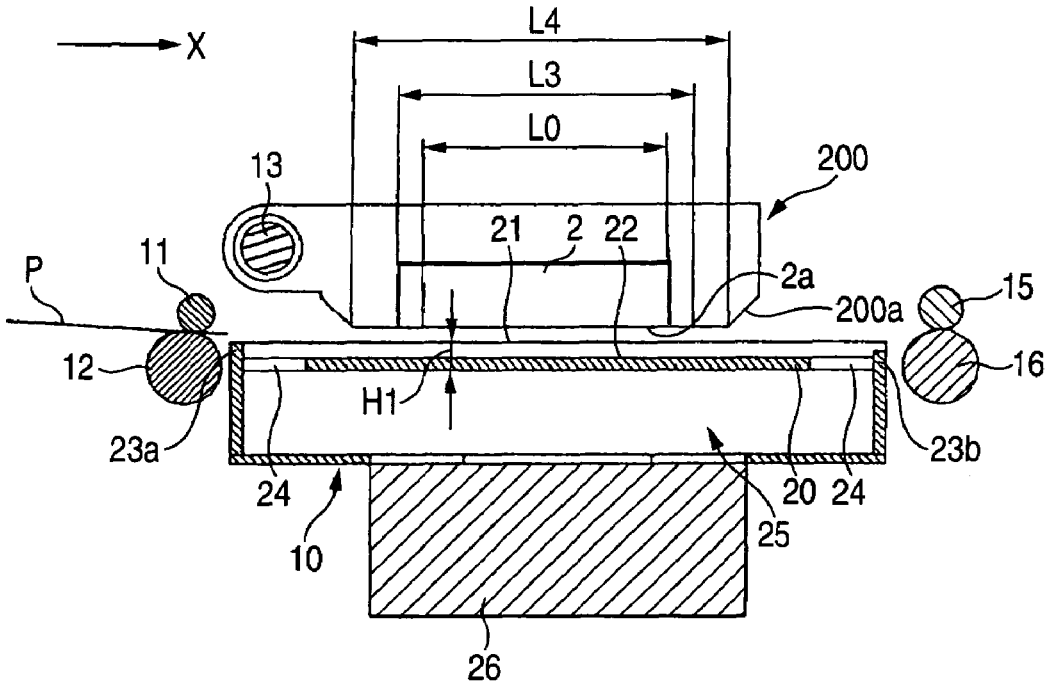
FIG. 3 is a sectional view taken along the line III—III in FIG. 2.

The configuration of the suction type platen 10 will be described below in detail. FIGS. 2 and 3 show a first embodiment of the suction type platen 10. As shown in FIGS. 2 and 3, the platen 10 is provided as a frame shaped like a box in plan view. A partition member 20 shaped like a flat plate is provided as a top surface of the platen 10 so that the partition member 20 faces the nozzle surface 2*a* of the recording head 2. A plurality of first protrusions 21 shaped like ribs extending in parallel with the feed direction (represented by an arrow X direction in FIG. 2) are provided on an upper surface of the partition member 20 so as to be arranged at regular intervals in a direction (represented by an arrow Y direction in FIG. 2) perpendicular to the feed direction. The respective first protrusions 21 are formed so as to extend to upstream and downstream sides in the feed direction with respect to an image forming region. The image forming region means a region which corresponds to the length (represented by the dimension L0 in FIG. 2) of a row of nozzles formed in the nozzle surface 2*a* of the recording head 2 and arranged at regular intervals along the feed direction. In the image forming region, an image can be formed by the recording head 2 making a unidirectional or reciprocating motion along the main scanning direction (the arrow Y direction). In FIG. 2, the image forming region is a region put between two chain lines L1 and L2.

A recess 22 extending along the feed direction is formed between every adjacent two of the first protrusions 21. In this embodiment, the top surface of each recess 22 is substantially on the same plane with the top surface of the partition member 20. Let H1 be the height between the top surface of each recess 22 and the top surface of each first protrusion 21 (i.e., a surface facing on the nozzle surface 2*a* of the recording head 2 or a surface facing the recording head 2 or the carriage 200 while coming into frictional contact with a sheet of paper P).

A second protrusion 23*a* shaped like a rib extending in a direction (the arrow Y direction) perpendicular to the feed direction is provided on the upstream side in the feed direction with respect to the image forming region so that the second protrusion 23*a* is joined (connected) to upstream ends of all the first protrusions 21. Other second protrusions 23*b* shaped like ribs are provided on the downstream side in the feed direction with respect to the image forming region so that each second protrusion 23*b* is joined (connected) to downstream ends of every adjacent two of the first protrusions 21 and that the height is changed for every other recess 22 (i.e., the height is equalized for every two recesses 22 partitioned by one recess 22). Incidentally, it is not necessary that the second protrusions 23*a* and 23*b* are connected to the first protrusions 21. For example, the second protrusions 23*a* and 23*b* may be adjacent to the first protrusions 21 via slight gaps. Also in this case, the flow of air (atmospheric air) in the recesses 22 is not blocked, and it is possible to obtain the same effect as in the case where the second protrusions 23*a* and 23*b* are connected continuously to the first protrusions 21.

Each of the recesses 22 has a pair of suction ports 24 provided on upstream and downstream sides respectively in the feed direction with respect to the image forming region. The pairs of suction ports 24 communicate with a negative pressure chamber 25 formed under the partition member 20 of the box frame-like platen 10 (see FIG. 3). The negative pressure chamber 25 is connected to a suction device 26 having a suction fan or a vacuum pump (see FIG. 3). Accordingly, the negative pressure chamber 25 is formed so that atmospheric air can be sucked in simultaneously through the pairs of suction ports 24 on the upstream and downstream sides by the operation of the suction device 26 at least at the time of formation of an image. Only one suction device connected to the negative pressure chamber 25 may be provided. In this case, the size of the image forming apparatus 1 can be reduced.

According to this configuration, when an image-forming (printer) command is issued by key entry in the operation panel portion not shown, the suction device 26 is operated and, at the same time, one of sheets of paper P stacked on the paper supply tray 5 is fed to the feed path 7 by one rotation of the paper supply roller 6, put between the pair of feed rollers 9*a* and 9*b* and fed to the pair of upstream feed rollers 11 and 12. Then, while a forward end portion of the sheet of paper P is nipped by a nip portion between the driven roller 11 and the drive roller 12, the drive roller 12 and the downstream drive roller 16 are rotated synchronously and intermittently. The intermittent rotation is repeated. When the sheet of paper P fed comes to the upstream side of the top surface of the platen 10 with respect to the image forming region, the negative pressure due to a current of air flowing into the upstream suction ports 24 sucks the sheet of paper P so that the forward end side of the sheet of paper P abuts against the top surfaces of the first protrusions 21. Even in the case where the forward end portion of the sheet of paper P is curled, the sheet of paper P is kept in parallel with the top surfaces of the first protrusions 21 of the platen 10. Accordingly, the sheet of paper P is prevented from coming into frictional contact with the nozzle surface 2*a* of the recording head 2 even in the case where the gap between the nozzle surface 2*a* and the top surface of each first protrusion 21 is narrow. As a result, the sheet of paper P is prevented from being stained. When the forward end portion of the sheet of paper P then enters the image forming region, a printing operation is executed. An air passage long along the feed direction is formed between the sheet of paper P placed on the top surfaces of the first protrusions 21 in the platen 10 and each recess 22. The air passage (air flow passage) communicates with the pairs of suction ports 24 provided on the upstream and downstream sides respectively with respect to the image forming region. Accordingly, a negative pressure is generated in the air passage, so that the sheet of paper P can be kept flat without floating up from the platen 10 during the printing operation and during the intermittent movement in the feed direction. As a result, the gap between the sheet of paper P and the nozzle surface 2*a* of the recording head 2 can be kept constant.

In this condition, the paper feed is temporarily suspended. While the recording head 2 is moved in the main scanning direction, ink is ejected from the nozzles to form an image on a predetermined region. Then, the sheet of paper P is intermittently fed by a predetermined distance in the sub-scanning direction. This series of operations is repeated.

When the rear end edge of the sheet of paper P departs from the place where the pair of upstream feed rollers 11 and 12 are provided, and comes to the downstream side of the upstream suction ports 24, the upstream suction port 24 side space becomes so large that the negative pressure of the space becomes low. The negative pressure due to the current of air flowing toward the suction port 24 located on the downstream side of each recess 22 is however kept constant. Accordingly, the sheet of paper P is sucked in so that the rear end side of the sheet of paper P abuts against the top surfaces of the first protrusions 21. Even in the case where the rear end portion of the sheet of paper P is curled, the sheet of paper P is kept in parallel with the top surfaces of the first protrusions 21 of the platen 10. Accordingly, the sheet of paper P is prevented from coming into contact with the nozzle surface 2*a* of the recording head 2. As a result, the sheet of paper P is prevented from being stained. Particularly, because the pairs of suction ports 24 are provided on the upstream and downstream sides respectively with respect to the image forming region, the sheet of paper P can be sucked onto the top surfaces of the first protrusions 21 before the forward end of the sheet of paper P comes near to the image forming region from the upstream side. Moreover, the state in which the sheet of paper P is sucked onto the top surfaces of the first protrusions 21 can be retained before the rear end of the sheet of paper P departs from the image forming region to the downstream side. Accordingly, the sheet of paper P is prevented from coming into contact with the nozzle surface 2*a* of the recording head 2, so that image quality is prevented from being deteriorated.

Moreover, because the recesses 22 extending in the feed direction are formed in the platen 10, both contact area and friction between the sheet of paper P and the platen 10 are reduced compared with the case where the platen 10 has no recess 22 and comes into planar contact with the sheet of paper P. Accordingly, an excessive feed load due to friction is prevented from being imposed on the sheet of paper P, so that good printing can be made (the same thing may apply to the following embodiments).

Incidentally, in the embodiment, each second protrusion 23*b* provided on the downstream side may be formed so as to be connected continuously to three or more adjacent first protrusions 21. Alternatively, an upstream second protrusion 23*a* and a downstream second protrusion 23*b* may be formed so as to be connected continuously to all the first protrusions 21. In this case, a pair of first protrusions 21 located at opposite widthwise ends of the sheet of paper P and the upstream and downstream second protrusions 23*a* and 23*b* form a frame shaped like a rectangle in plan view.

Figure 4:
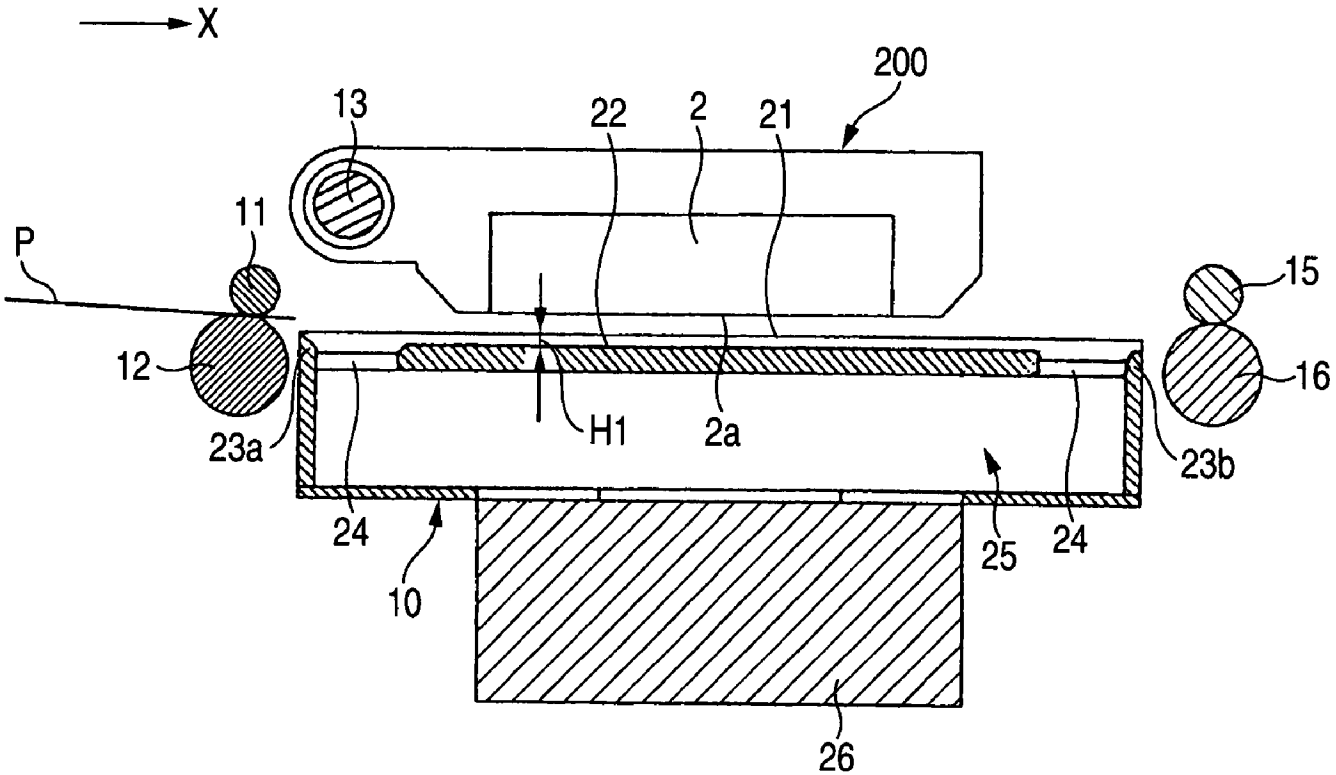
FIG. 4 is a sectional view like FIG. 3, showing a modification of the first embodiment.

If the height of the upstream second protrusion 23*a* is made to be equal to the height of the first protrusions 21 while the height of each downstream second protrusion 23*b* is made to be lower than the height of the first protrusions 21 (see FIGS. 3 and 4), it is possible to prevent the phenomenon that the forward end edge of the sheet of paper P coming near to the second protrusion 23*b* from the upstream side collides with the second protrusion 23*b* located on the downstream side and floats up on the downstream side of each recess 22. If the upper end of the downstream second protrusion 23*b* set to be low in height is cut down toward the upstream side (see FIG. 4) or if the downstream second protrusion 23*b* is entirely removed so that each recess 22 is completely opened to the downstream side, the phenomenon of collision can be eliminated perfectly. When portions of the recesses 22 adjacent to the upstream suction ports 24 are cut down toward the upstream side while the upper end of the upstream second protrusion 23*a* is cut down toward the downstream side (see FIG. 4), it is possible to change smoothly the direction of the current of air sucked in the suction ports 24 from above the platen 10.

Figure 5:
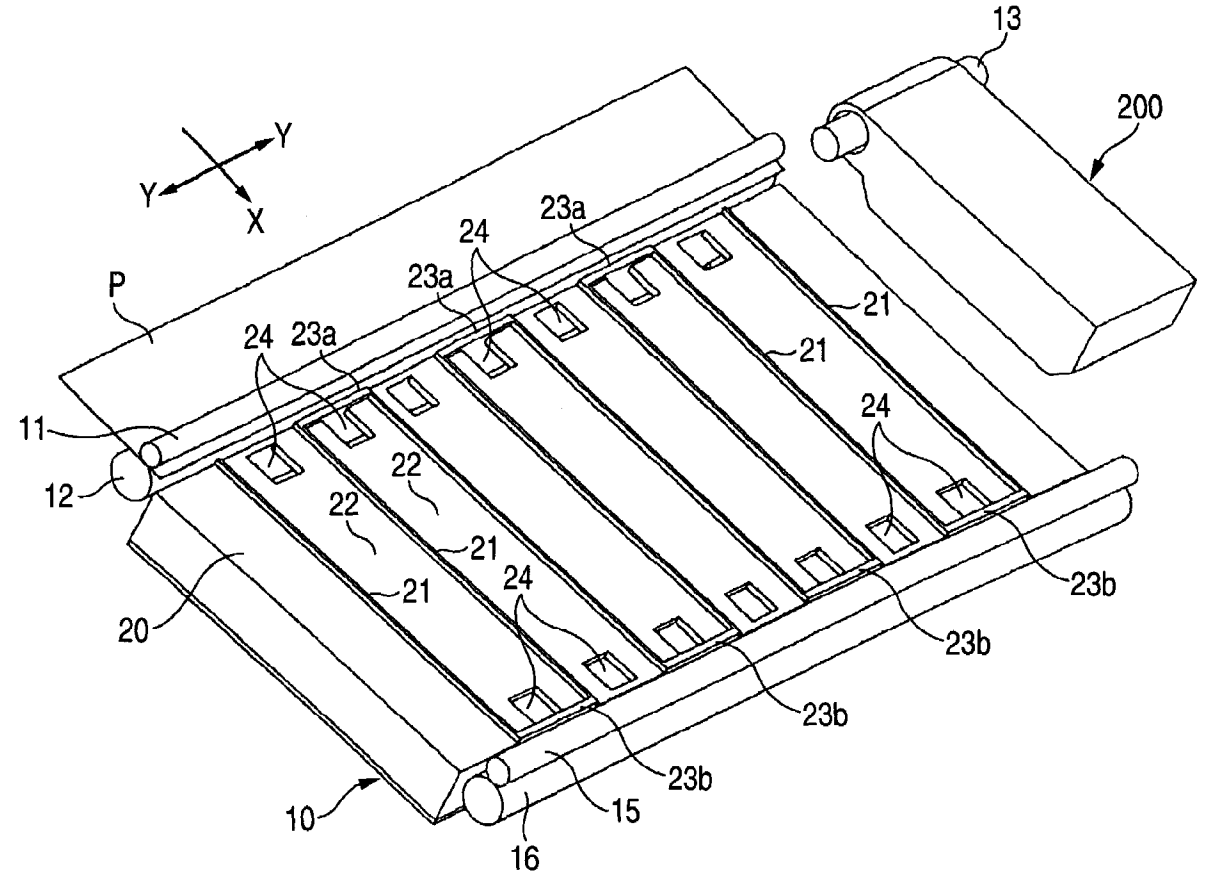
FIG. 5 is a perspective view showing a platen according to another modification of the first embodiment.

FIG. 5 shows a modification of the first embodiment. In this modification, upstream second protrusions 23*a* and downstream second protrusions 23*b*, which extend in a direction perpendicular to the feed direction of the sheet of paper and each of which is connected to at least adjacent two of the first protrusions 21, are provided so as not to face each other on the upstream and downstream sides in the feed direction of the sheet of paper with respect to the image forming region. For example, as shown in FIG. 5, when the platen 10 is viewed from the left end in FIG. 5, the downstream second protrusions 23*b* are provided so as to extend in the arrow Y direction so that downstream ends of the leftmost and second leftmost first protrusions 21 are connected to each other, downstream ends of the third leftmost and fourth leftmost first protrusions 21 are connected to each other, downstream ends of the fifth leftmost and sixth leftmost first protrusions 21 are connected to each other and downstream ends of the seventh leftmost and eighth leftmost first protrusions 21 are connected to each other. On the other hand, when the platen 10 is viewed from the left end in FIG. 5 in the same manner as described above, the upstream second protrusions 23*a* are provided so as to extend in the arrow Y direction so that upstream ends of the second leftmost and third leftmost first protrusions 21 are connected to each other, upstream ends of the fourth leftmost and fifth leftmost first protrusions 21 are connected to each other and upstream ends of the sixth leftmost and seventh leftmost first protrusions 21 are connected to each other. In other words, the second protrusions 23*a* and the second protrusions 23*b* are arranged alternately (by turns) with respect to the upstream and downstream sides of adjacent two of the first protrusions 21.

As shown in FIG. 5, each of the recesses 22 has a pair of suction ports 24 provided on the upstream and downstream sides respectively in the feed direction of the sheet of paper with respect to the image forming region. The pairs of suction ports 24 are formed so as to communicate with a negative pressure chamber 25 formed under the partition member 20 of the box frame type platen 10. The negative pressure chamber 25 is connected to the suction device 26 having a suction fan or a vacuum pump. Accordingly, the negative pressure chamber 25 is formed so that atmospheric air can be sucked in through the upstream suction ports 24 and the downstream suction ports 24 simultaneously when the suction device 26 operates.

Also in this modification, when a sheet of paper P to be fed comes to the upstream side of the image forming region on the upper surface of the platen 10, the sheet of paper P is sucked in by a negative pressure due to the current of air flowing into the upstream suction ports 24 so that the forward end side of the sheet of paper P abuts against the upper surfaces of the first protrusions 21. As a result, the sheet of paper P is kept parallel with the upper surfaces of the first protrusions 21 of the platen 10 even if the forward end portion of the sheet of paper P is curled. In addition, in the portion of each recess 22 having no upstream second protrusion 23*a*, a current of air for applying a negative pressure onto the lower surface of the sheet of paper P flows into a corresponding upstream suction port 24. This is effective in increasing suction force by which the sheet of paper P is attracted to the upper surfaces of the first protrusions 21 of the platen 10.

Incidentally, in this modification, it is not necessary that the first protrusions 21 are connected to the second protrusions 23*a* and 23*b*. That is, the first protrusions 21 may be formed so as to be adjacent to the second protrusions 23*a* and 23*b* with slight gaps (the same thing may apply to the following embodiments).

Figure 6:
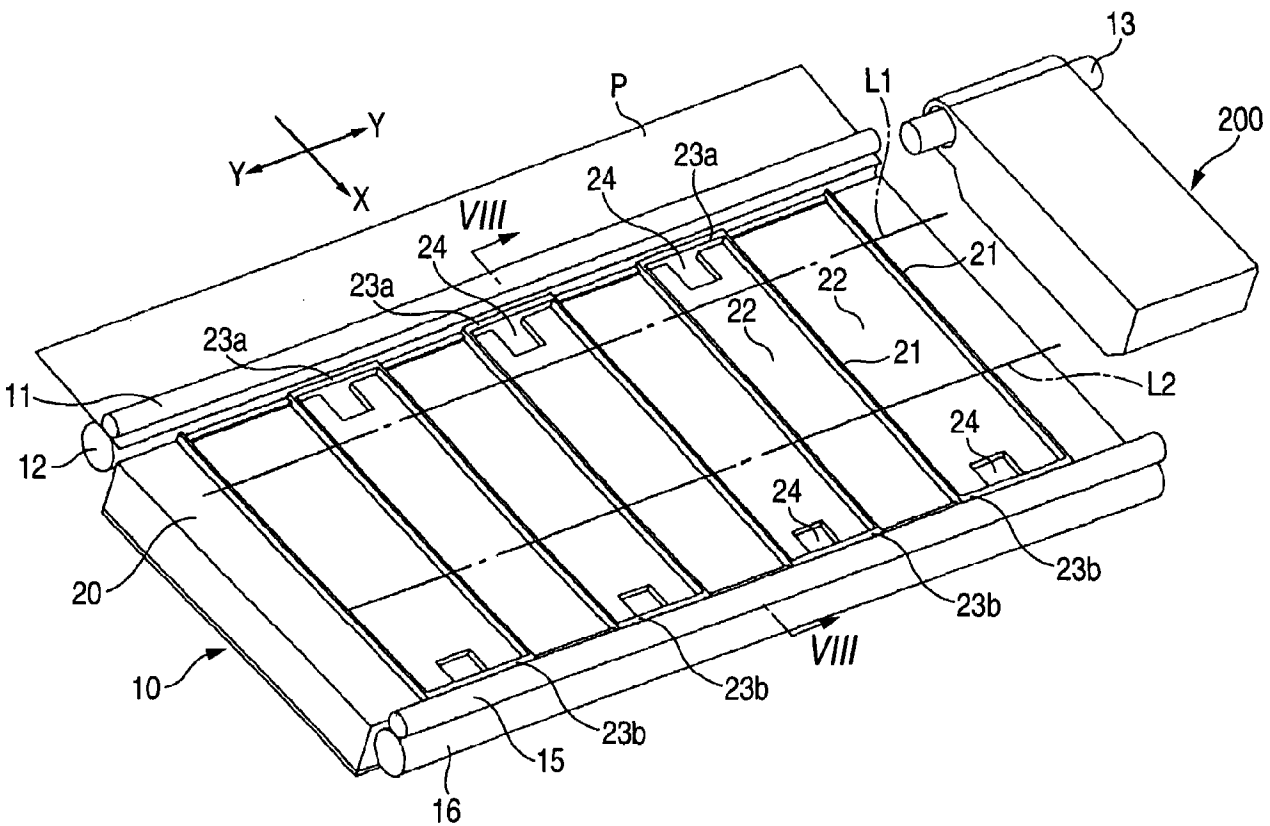
FIG. 6 is a perspective view showing a platen according to a second embodiment of the invention.
Figure 7:
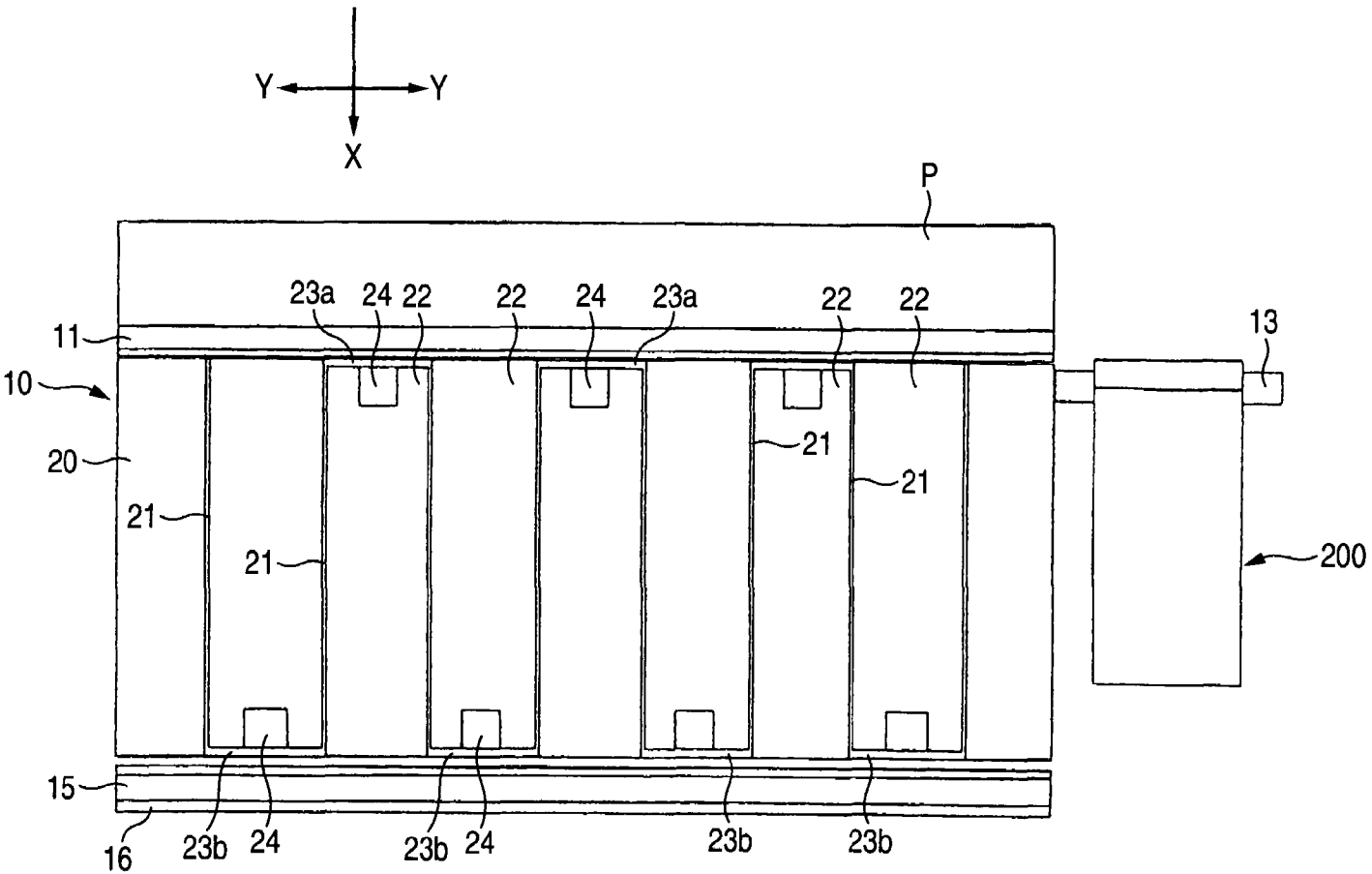
FIG. 7 is a plan view of the platen according to the second embodiment.
Figure 8:
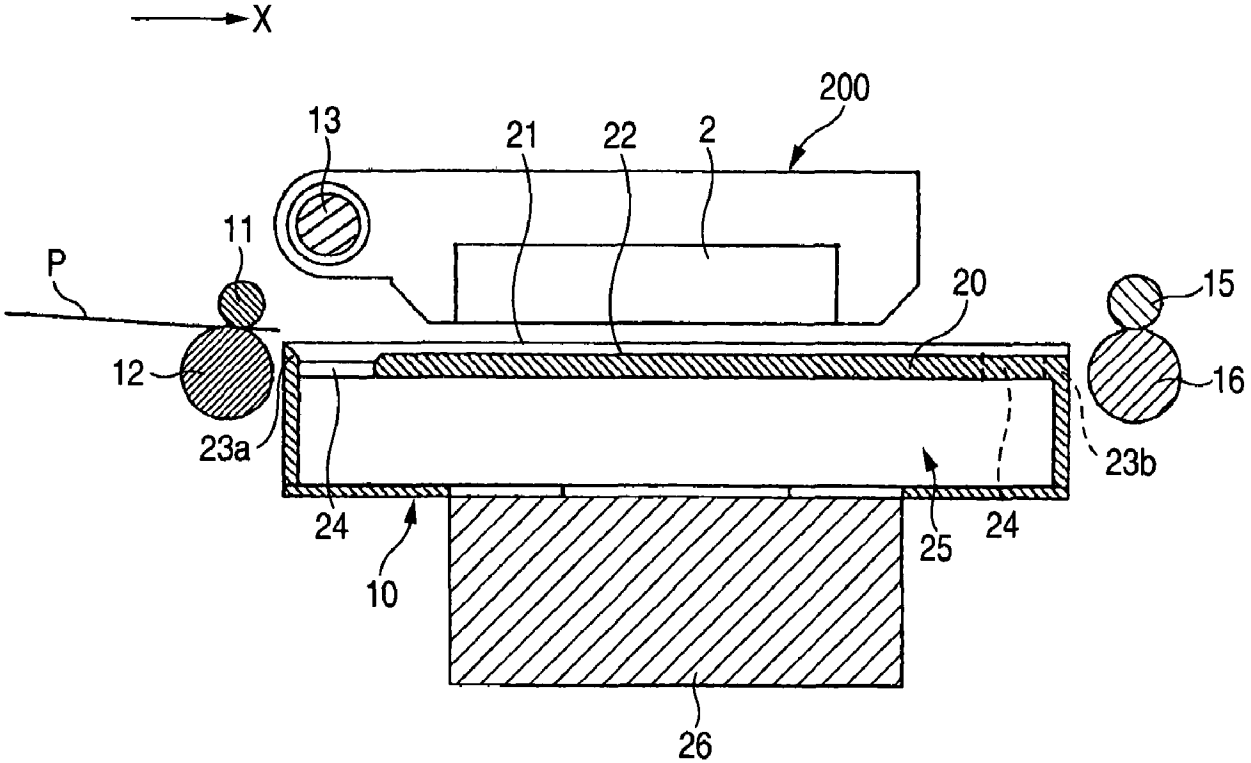
FIG. 8 is a sectional view taken along the line VIII—VIII in FIG. 6.

FIGS. 6 to 8 show a second embodiment of the invention. In this embodiment, the platen 10 is provided as a frame shaped like a box in plan view. A partition member 20 shaped like a flat plate is provided on the upper surface of the platen 10 so as to face the nozzle surface 2*a* of the recording head 2. Rib-like first protrusions 21 extending in parallel with the feed direction (referred to as the arrow X direction in FIGS. 6 and 7) are provided on the upper surface of the partition member 20 so as to be arranged at regular intervals in a direction (referred to as the arrow Y direction in FIGS. 6 and 7) perpendicular to the feed direction. Each first protrusion 21 is formed so as to extend to the upstream and downstream sides in the feed direction with respect to the image forming region. Recesses 22 extending in the feed direction of the sheet of paper are provided between adjacent ones of the first protrusions 21.

Upstream second protrusions 23*a* and downstream second protrusions 23*b*, which extend in the direction perpendicular to the feed direction of the sheet of paper and each of which is connected to at least adjacent two of the first protrusions 21, are provided so as not to face each other on the upstream and downstream sides in the feed direction of the sheet of paper with respect to the image forming region. For example, as shown in FIGS. 6 and 7, when the platen 10 is viewed from the left end in FIG. 6, the downstream second protrusions 23*b* are provided so as to extend in the arrow Y direction so that downstream ends of the leftmost and second leftmost first protrusions 21 are connected to each other, downstream ends of the third leftmost and fourth leftmost first protrusions 21 are connected to each other, downstream ends of the fifth leftmost and sixth leftmost first protrusions 21 are connected to each other and downstream ends of the seventh leftmost and eighth leftmost first protrusions 21 are connected to each other. On the other hand, when the platen 10 is viewed from the left end in FIG. 6 in the same manner as described above, the upstream second protrusions 23*a* are provided so as to extend in the arrow Y direction so that upstream ends of the second leftmost and third leftmost first protrusions 21 are connected to each other, upstream ends of the fourth leftmost and fifth leftmost first protrusions 21 are connected to each other and upstream ends of the sixth leftmost and seventh leftmost first protrusions 21 are connected to each other. In other words, the second protrusions 23*a* and the second protrusions 23*b* are arranged alternately (by turns) with respect to the upstream and downstream sides of adjacent two of the first protrusions 21.

As shown in FIGS. 6 and 7, each of the recesses 22 has a suction port 24 provided in only one predetermined region nearer to the location of a corresponding second protrusion 23*a* or 23*b* on the upstream or downstream side in the feed direction of the sheet of paper with respect to the image forming region. The upstream and downstream suction ports 24 communicate with a negative pressure chamber 25 formed under the partition member 20 of the box frame type platen 10. The negative pressure chamber 25 is connected to the suction device 26 having a suction fan or a vacuum pump. Accordingly, the negative pressure chamber 25 is formed so that atmospheric air can be sucked in through the upstream suction ports 24 and the downstream suction ports 24 simultaneously when the suction device 26 operates.

In this embodiment, currents of air in adjacent recesses 22 do not interfere with each other even if the directions of the currents of air are different from each other. Accordingly, even in the case where suction acts both on the suction ports 24 for sucking the forward end of the sheet of paper P as a free end and on the suction ports 24 for sucking the rear end of the sheet of paper P on the downstream side, currents of air flowing in individual directions in the recesses 22 functioning as air passages are not weakened so that the suction action is stabilized. In addition, there is no suction port 24 provided near to the place where there is no second protrusion 23*a* or 23*b* so that each recess 22 is opened to the upstream or downstream side. That is, each suction port 24 is provided only in a region near to the place where a corresponding second protrusion 23*a* or 23*b* extends so as to come near to the rear surface (lower surface) of the sheet of paper P. Accordingly, it is easy to generate a current of air along the platen 10.

Figure 9:
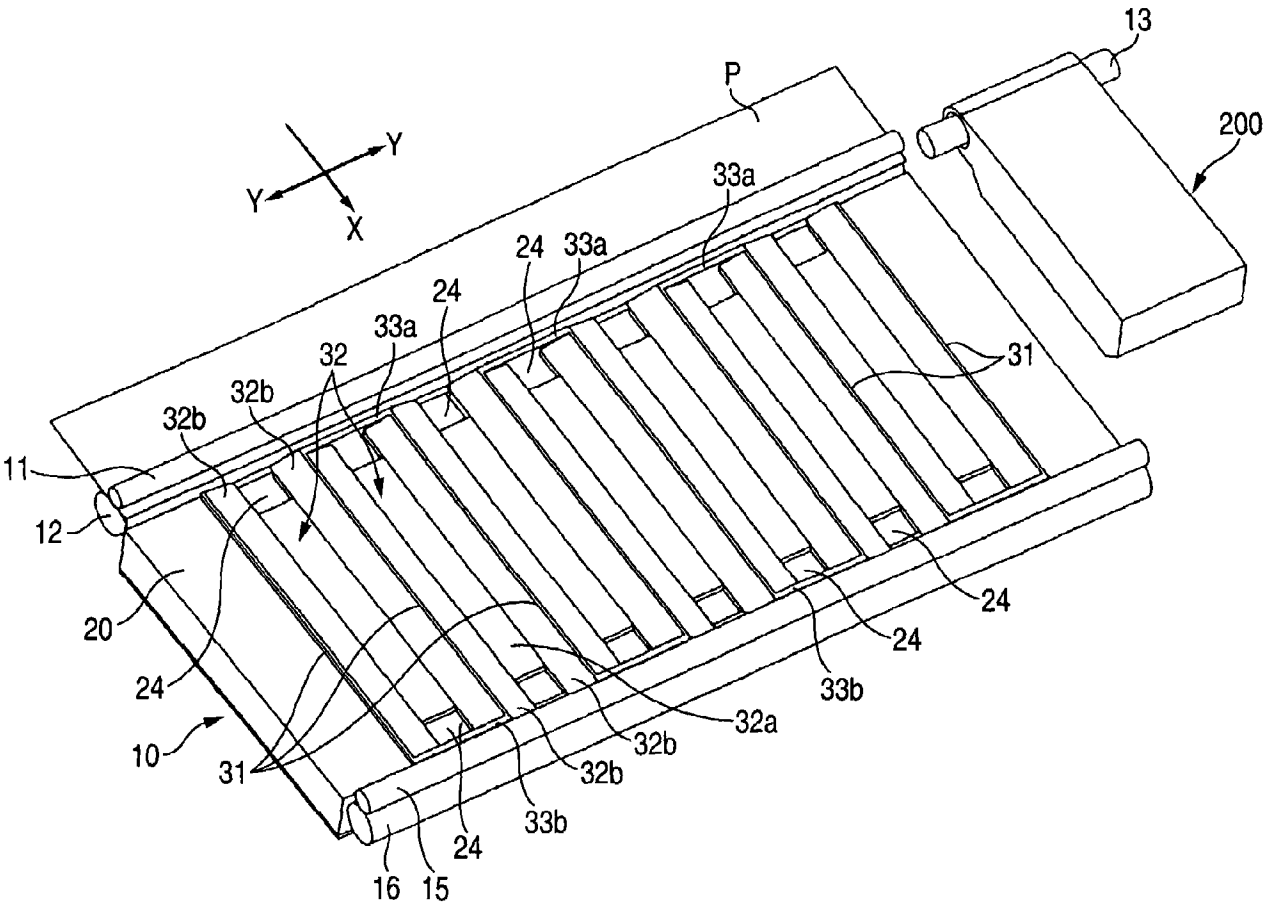
FIG. 9 is a perspective view showing a platen according to a third embodiment of the invention.
Figure 10:
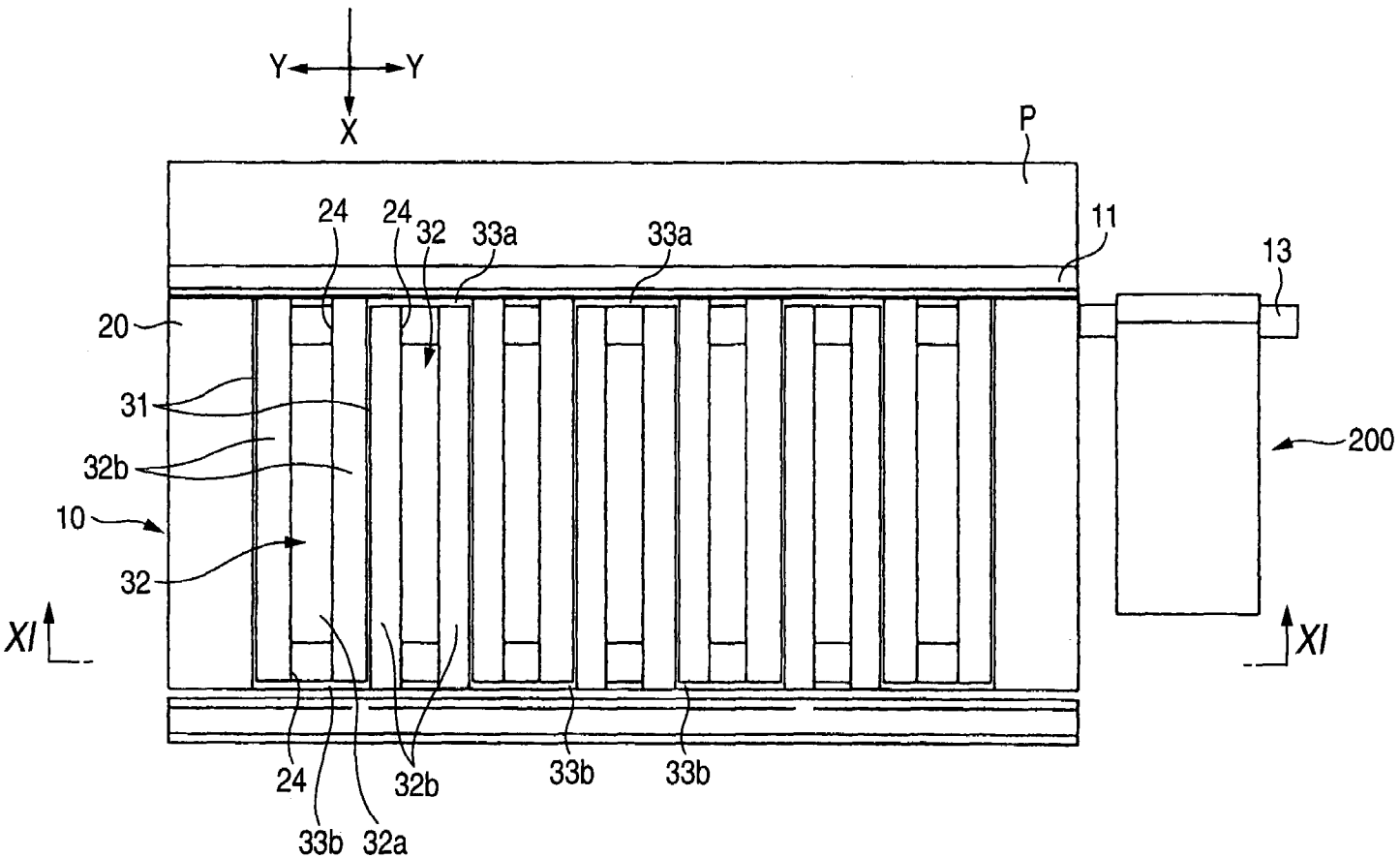
FIG. 10 is a plan view of the platen according to the third embodiment.
Figure 11:
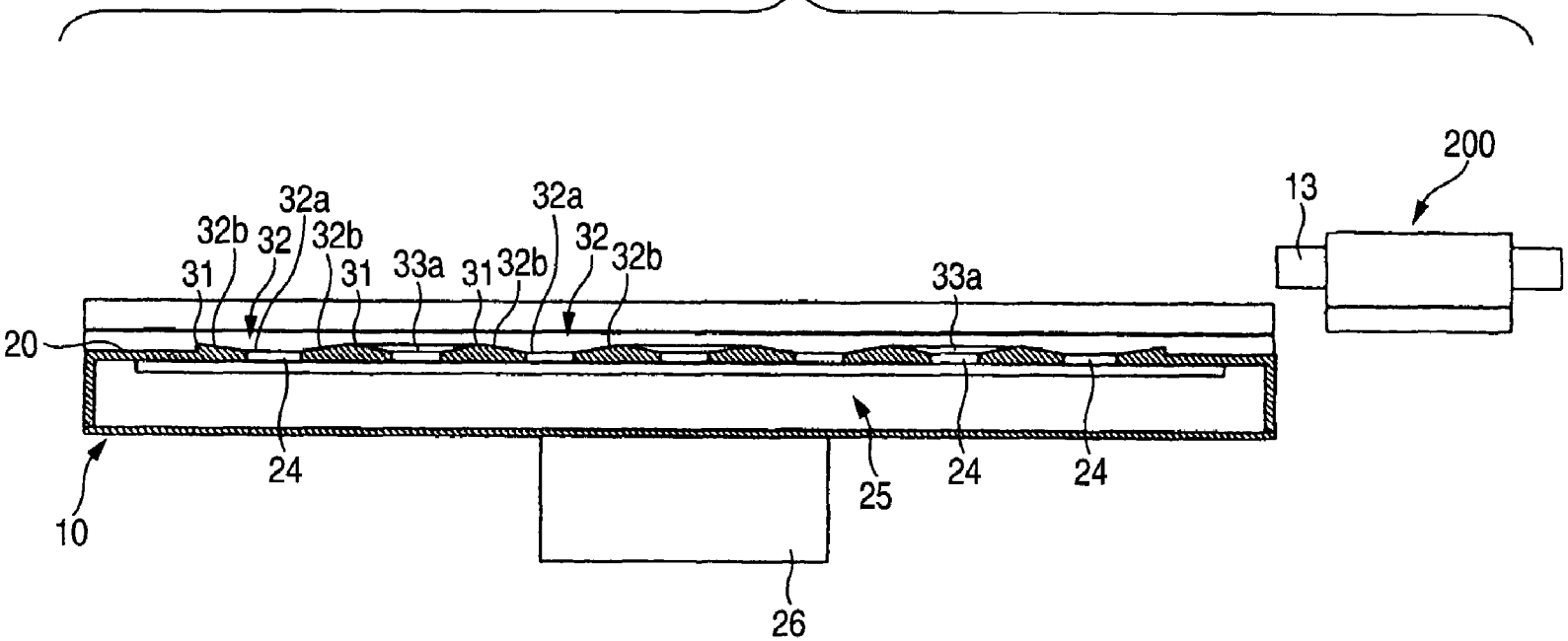
FIG. 11 is a sectional view taken along the line XI—XI in FIG. 10.

FIGS. 9 to 11 show a third embodiment of the invention. In this embodiment, the platen 10 is provided as a frame shaped like a box in plan view. A partition member 20 shaped like a flat plate is provided on the upper surface of the platen 10 so as to face the nozzle surface 2*a* of the recording head 2. Narrow first protrusions 31 extending in parallel with the feed direction (referred to as the arrow X direction in FIGS. 9 and 10) are provided on the upper surface of the partition member 20 so as to be arranged at regular intervals in a direction (referred to as the arrow Y direction in FIGS. 9 and 10) perpendicular to the feed direction. Each first protrusion 31 is formed so as to extend to the upstream and downstream sides in the feed direction with respect to the image forming region. Recesses 32 extending in the feed direction of the sheet of paper are provided between adjacent ones of the first protrusions 31. As shown in FIGS. 9 and 11, each recess 32 has a bottom 32*a* disposed in the middle between adjacent ones of the first protrusions 31 so as to be equal in height to the front surface of the partition member 20, and a pair of slopes 32*b* extending from both sides of the bottom 32*a* to the upper surfaces of the adjacent first protrusions 31, respectively. Each of the slopes 32*b* is formed so as to be along the direction of extension of a corresponding first protrusion 31. Upstream second protrusions 33*a* and downstream second protrusions 33*b*, which extend in a direction perpendicular to the feed direction, are provided so as not to face each other, on the upstream and downstream sides in the feed direction of the sheet of paper with respect to the image forming region in the same manner as in the second embodiment. That is, the second protrusions 33*a* and the second protrusions 33*b* are arranged alternately (by turns) with respect to the upstream and downstream sides of adjacent two first protrusions 31. Each recess 32 has a pair of suction ports 24 formed on the upstream and downstream sides respectively in the feed direction of the sheet of paper with respect to the image forming region. As to other configurations, this embodiment is the same as the first and second embodiments. Like structures or like parts are referred to by like numerals for the sake of omission of duplicated description. When each recess 32 is formed to have a bottom 32*a* and a pair of slopes 32*b* provided on both (left and right) sides of the bottom 32*a* as shown in the third embodiment so that a cross section of the recess 32 taken in a direction perpendicular to the feed direction is shaped like a trapezoid, the amount of the current of air flowing into the recess 32 to suck the lower surface of the sheet of paper P abutting against the first protrusions 31 can be reduced. Accordingly, energy such as electric power consumed by the suction device 26 can be reduced. This is effective in reducing the size of the suction device 26.

Figure 12:
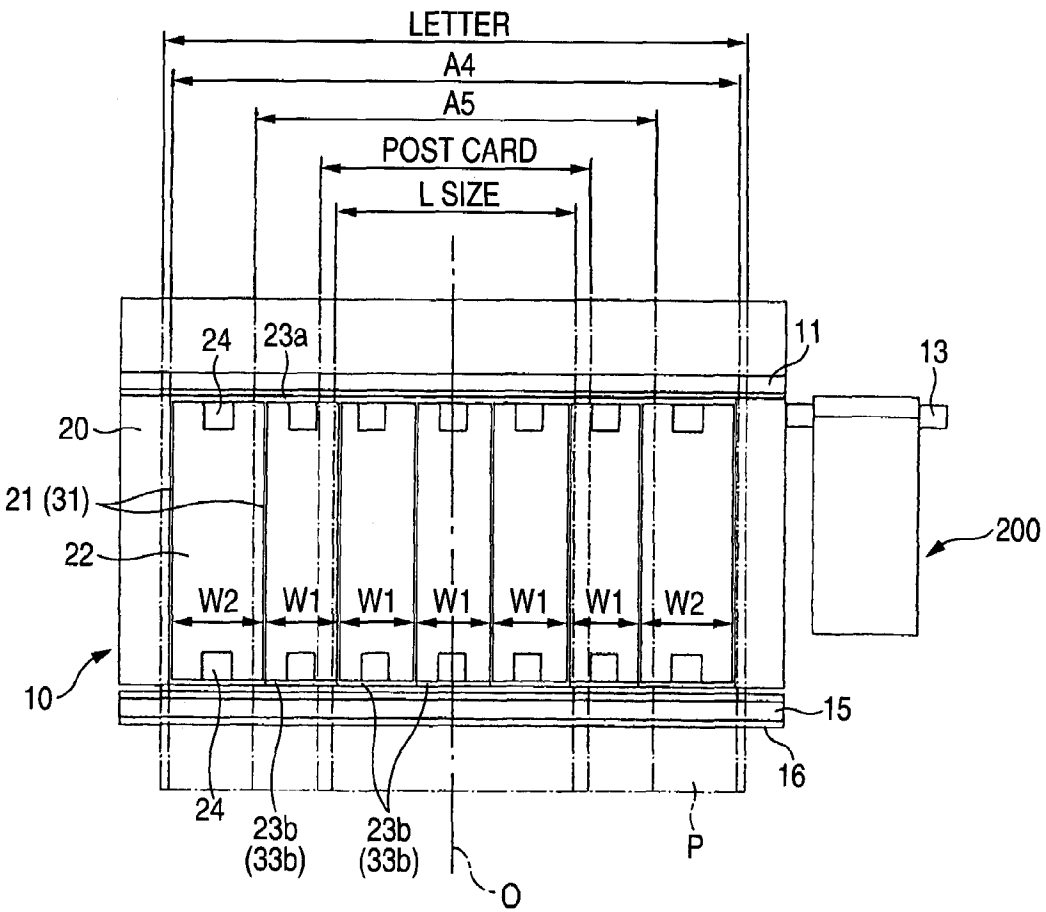
FIG. 12 is a plan view showing a further embodiment.
Figure 13:
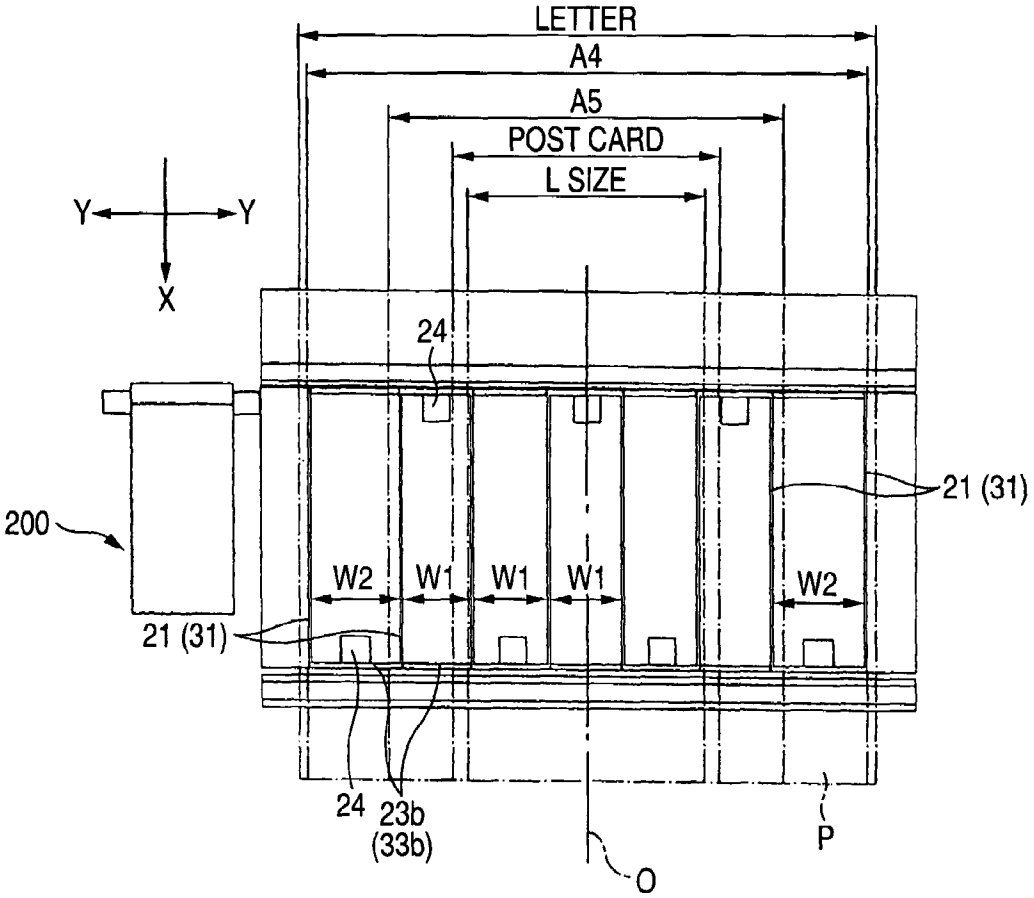
FIG. 13 is a plan view showing a further embodiment.

In the modification of the first embodiment or in the second or third embodiment, the sheet of paper P may be fed in the condition that the widthwise center line of the sheet of paper P is made substantially coincident with the lengthwise center line O of the platen 10 in a direction perpendicular to the feed direction as shown in FIGS. 12 and 13. In this case, the height of the second protrusions 23*b* (33*b*) corresponding to the position of the side edge of the sheet of paper P in a direction perpendicular to the feed direction and arranged on the downstream side is set to be lower than the height of the first protrusions 21 (31) or the second protrusions 23*b* (33*b*) are dispensed with. For example, the height of the second protrusions 23*b* (33*b*) arranged on the downstream side of the place where the left and right edges of the sheet of paper P pass along the feed direction is set to be lower than the height of the first protrusions 21 (31) in accordance with the width of the sheet of paper P such as letter size, A4-size, A5-size, postcard size or L-size or the second protrusions 23*b* (33*b*) are removed. Accordingly, even in the case where the left and right edges of the sheet of paper P pass while caved in the recesses 22 (32), the forward end edge of the sheet of paper P advancing can be restrained or prevented from colliding with the second protrusions 23*b* (33*b*). As a result, the phenomenon of floating of the sheet of paper P can be suppressed.

As shown in FIG. 12 or 13, while the first protrusions 21 (31) are arranged so as to be symmetrical with respect to the center line O, the interval between adjacent ones of the first protrusions 21 (31) may be set so that the interval W2 between the adjacent first protrusions 21 (31) in each of left and right portions of the platen 10 is wider than the interval W1 between the adjacent first protrusions 21 (31) in the central portion of the platen 10 in a direction perpendicular to the feed direction. In this case, the phenomenon of floating of the sheet of paper P can be suppressed because places near to the left and right edges of the sheet of paper P can be easily supported by the first protrusions 21 (31) when the sheet of paper P is fed in accordance with standard sizes (such as letter size, A4-size, A5-size, postcard size and L-size) different in width of the sheet of paper P, compared with the case where all the adjacent first protrusions 21 (31) are arranged at regular intervals.

Figure 14:
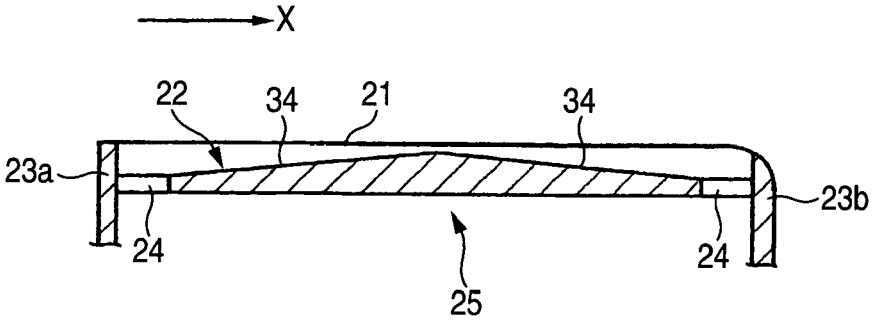
FIG. 14 is a sectional view showing a further embodiment of the recess with respect to the upstream and downstream suction ports.
Figure 15:
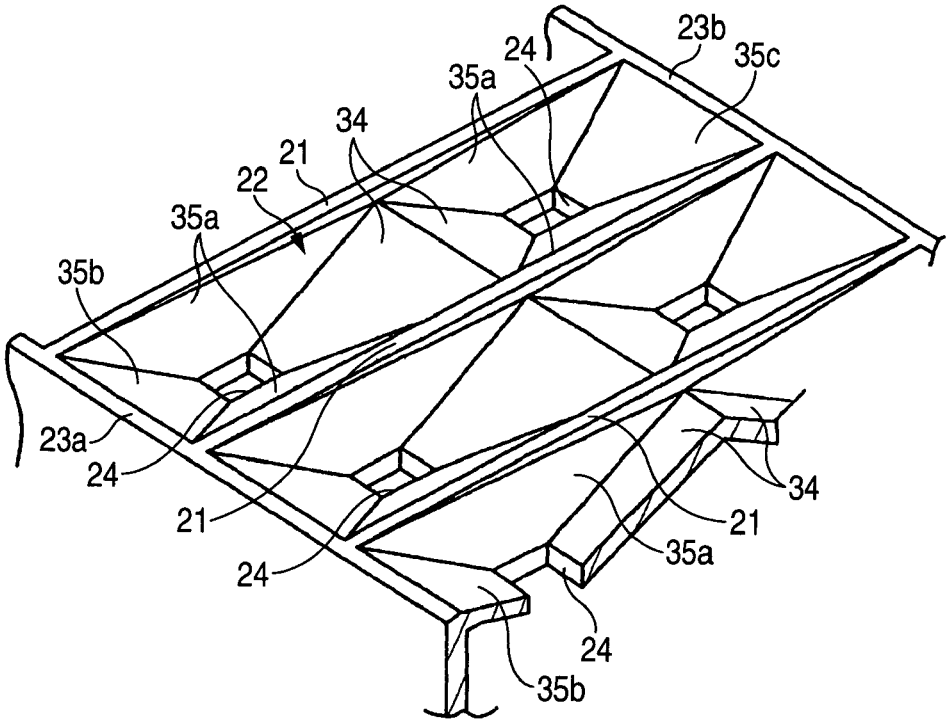
FIG. 15 is a perspective view showing a further embodiment of the recess with respect to the upstream and downstream suction ports.
Figure 16:
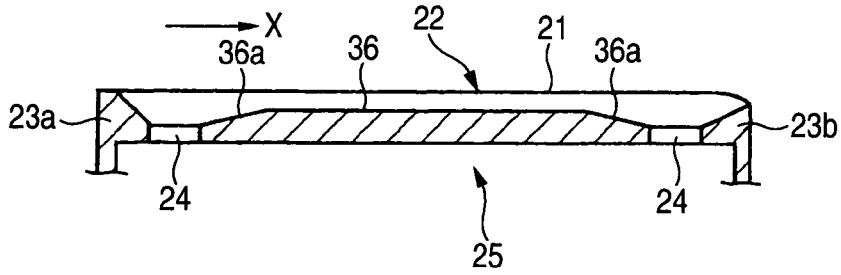
FIG. 16 is a sectional view showing a further embodiment of the recess with respect to the upstream and downstream suction ports.

FIGS. 14 to 16 show other embodiments of the section of each recess 22 taken along the feed direction in the aforementioned embodiment in which each recess 22 has a pair of suction ports 24 provided on the upstream and downstream sides, respectively. In the embodiment shown in FIG. 14, slopes 34 are formed so that the bottom of each recess 22 is highest in the middle between the upstream and downstream sides but becomes lower as the location of the recess 22 approaches each suction port 24. In the embodiment shown in FIG. 15, each recess 22 has, in addition to the slopes 34 shown in FIG. 14, down slopes 35*a* continued from the first protrusion 21 side, and down slopes 35*b* and 35*c* continued from the second protrusions 23*a* and 23*b*.

According to these embodiments, the volume of the space formed by the recesses 22 and the sheet of paper P can be reduced compared with the case where the bottom of each recess 22 is flat. As a result, the amount of the air current passing through the suction ports 24 can be reduced, so that the suction can be performed well even in the case where the power of the suction device 26 is low. In addition, a current of air flowing toward the upstream suction ports 24 in the recesses 22 can be surely separated from a current of air flowing toward the downstream suction ports 24. As a result, the action of sucking the forward end edge of the sheet of paper P freed as described above and the action of sucking the rear end edge of the sheet of paper P can be performed surely and efficiently.

In the embodiment shown in FIG. 16, each recess 22 has a stripe 36, which is substantially parallel with the first protrusions 21, in the middle between the upstream and downstream sides of the recess 22 and extends in the feed direction in the location lower than the height of the first protrusions 21. Slopes 36*a* are formed at places where the stripe 36 comes near to the upstream and downstream suction ports 24. Also in this embodiment, the volume of each recess 22 can be reduced. This is effective in reducing the amount of the air current flowing in the suction ports 24.

In FIG. 16, there may be conceived a modification in which the stripe 36 is directly connected to the suction ports 24. However, when there is any corner, the air passage is narrowed and the loss of the air current increases. Accordingly, suction efficiency cannot be improved even in the case where the suction volume (volume of the air passage) is small. It is therefore preferable that the slopes 36*a* are formed.

Figure 17A:
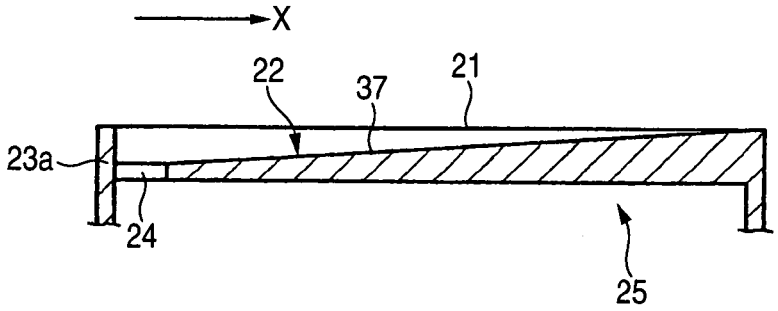
FIG. 17A is a sectional view showing slopes with respect to the upstream suction port.
Figure 17B:
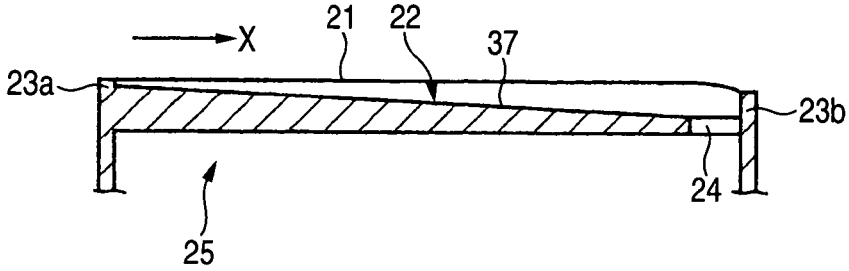
FIG. 17B is a sectional view showing slopes with respect to the downstream suction port.

FIGS. 17A and 17B show the case where a single-flow slope 37 is formed so that the bottom of each recess 22 becomes lower as the location of the recess 22 approaches a corresponding suction port 24 in the aforementioned embodiment in which the recess 22 has a suction port 24 on either of the upstream and downstream sides. Also in this case, the cross-sectional area of each recess 22 can be reduced, so that the amount of the current of air flowing in the suction port 24 can be reduced. In addition, there is obtained an effect that the current of air flowing toward the suction port 24 can be made surely.

It is not necessary that the second protrusions 23*a* and 23*b* are connected to the first protrusions 21. That is, the second protrusions 23*a* and 23*b* may be disposed so as to be adjacent to the first protrusions 21 with slight gaps.

In each of the aforementioned embodiments, the width (in a direction perpendicular to the feed direction) of the upper surface (facing the nozzle surface 2*a* of the recording head 2 and abutting against the sheet of paper P) of each first protrusion 21 may be widened. Similarly, the width (in the feed direction) of the upper surface of each second protrusion 23*a*, 23*b* may be widened. At least one notch may be provided in the middle in the lengthwise direction (feed direction) of each first protrusion 21 so that a current of air can flow into adjacent recesses 22.

The platen 10 may be entirely convexly curved so that the platen 10 is high in the middle in a direction (widthwise direction of the sheet of paper P) perpendicular to the feed direction but becomes lower on both sides of the width of the sheet of paper.

Incidentally, when L3 (>Lo) is set as the length, in the feed direction, of the nozzle surface 2*a* having the nozzle array and L4 (>L3>Lo) is set as the length, in the feed direction, of the surface, which is of the recording head 2 or the carriage 200 equipped with the recording head 2, facing the platen 10 (see FIG. 3), a pass region (not shown) in which the nozzle surface 2*a* or the surface of the recording head 2 or the carriage 200 equipped with the recording head 2 passes through the upper surface of the platen 10 while facing the platen 10 when the surface moves in a direction perpendicular to the feed direction is larger than the image forming region. The nozzle surface 2*a* or the surface, which is of the recording head 2 or the carriage 200 equipped with the recording head 2, facing the platen 10 confronts the upper surface of the platen 10. In a region in which the gap between the two surfaces is small, a current of air generated in the suction port 24 causes a current of air generated between the recording head 2/carriage 200 and the print surface of the sheet of paper P. As a result, the air current has bad influence on image quality. Therefore, when the suction ports 24 are provided on the upstream and/or downstream sides except such region, the action of sucking the forward end edge of the sheet of paper P freed as described above and the action of sucking the rear end edge of the sheet of paper P can be performed on the outside of the pass region. Accordingly, the sheet of paper P can be prevented from coming into contact with the nozzle surface 2*a* on which ink is apt to be deposited, or with the surface, which is of the recording head 2 or the carriage 200 equipped with the recording head 2, facing the platen 10. As a result, the sheet of paper P can be surely prevented from being stained with ink.

Although description has been made on the case where the spurs of the driven roller 15 are rotatably supported by one shaft, the invention may be also applied to the case where the spurs of the driven roller 15 are one-by-one urged to be pressed against the drive roller 16 by elastic springs respectively.

Incidentally, in the case where the suction ports 24 are kept away from the range in which the recording head 2 faces on the platen 10, good printing can be made because the influence due to suction of atmospheric air in accordance with ejection of ink is slight compared with the case where the suction ports 24 are kept away from the range in which the nozzle array of the nozzle surface 2*a* of the recording head 2 faces on the platen 10.

The invention may be further applied to an image forming apparatus of the type in which the carriage 200 equipped with the recording head 2 moves in a direction perpendicular to the feed direction, and an image forming apparatus of the type in which the recording head does not move because the recording head is formed so as to be long in a direction perpendicular to the feed direction (that is, an image forming apparatus having a line type recording head in which an image can be formed at once on the whole width of the sheet of paper P).

As shown in FIG. 3, the lower portion 200*a* of the carriage 200 surrounding the nozzle surface 2*a* of the recording head 2 is formed to have a height equal to that of the nozzle surface 2*a*. The lower portion 200*a* is provided so that the carriage 200 can hold the recording head 2. It is preferable that the lower portion 200*a* is farther than the nozzle surface 2*a* from the platen 10 i.e., the lower portion 200*a* is disposed at a high position), if possible. In this case, the "height substantially equal to that of the nozzle surface 2*a*" means a lower limit of height in which a current of air generated by the suction ports 24 has influence on the space between the nozzle surface 2*a* and the sheet of paper P so that the position where ink ejected from the nozzles lands on the sheet of paper P is changed from an appropriate position.

As shown in FIGS. 2, 5, 9 and 12, while the suction ports 24 are provided on the upstream and downstream sides respectively with respect to the image forming region, the total area of the upstream suction ports 24 and the total area of the downstream suction ports 24 are set to be equal to each other so that the force for sucking the sheet of paper P on the upstream side and the force for sucking the sheet of paper P on the downstream side with respect to the image forming region are made equal to each other. The total area of the upstream suction ports 24 and the total area of the downstream ports 24 may be however made different from each other if there is no obstacle to printing. With this configuration, the action of suction performed on the sheet of paper can be made appropriate.

What is claimed is:

1. An image forming apparatus comprising:

an image forming unit which forms an image on one surface of a printing medium;

a platen;

a feeding device which transports the printing medium in a feed direction along the platen while the other surface of the printing medium faces a surface of the platen; and a suction device which sucks air, wherein:

the platen includes:

first protrusions which protrude from the surface of the platen and extend in parallel with the feed direction and are arranged at predetermined intervals in a direction perpendicular to the feed direction;

recesses which are defined between adjacent ones of the first protrusions and extend in the feed direction;

second protrusions which protrude from the surface of the platen and are provided on downstream and upstream sides, respectively, in the feed direction with respect to an image forming region where the image forming unit forms an image, and extend in the direction perpendicular to the feed direction; and suction ports which are defined on both the downstream and upstream sides, respectively, in the feed direction with respect to the image forming region in each of recesses surrounded by the adjacent ones of the first protrusions and the second protrusions on the upstream side and the downstream side, and communicate with the suction device, wherein the image forming unit includes a carriage which moves the recording head forward and backward in a predetermined direction; and the suction ports are provided outside a region where the carriage has substantially the same height as the nozzle surface of the recording head.

2. The image forming apparatus according to claim 1, wherein each of second protrusions is connected to or adjacent to at least two of the first protrusions.

3. The image forming apparatus according to claim 1, wherein:

a height of each second protrusion provided on the upstream side in the feed direction is substantially equal to those of the first protrusions; and a height of each second protrusion provided on the downstream side in the feed direction is lower than those of the first protrusions.

4. The image forming apparatus according to claim 1, wherein at least one of the recesses includes a slope which is formed between at least one of the first and second protrusions and the suction ports.

5. The image forming apparatus according to claim 1, wherein a height of each second protrusion, which corresponds to a position of each side edge of the printing medium in the direction perpendicular to the feed direction and is provided on the downstream side in the feed direction, is lower than those of the first protrusions or substantially equal to those of the recesses.

6. The image forming apparatus according to claim 1, wherein the first protrusions are arranged at such intervals that the interval on an end side of the platen is wider than that on a central portion of the platen in the direction perpendicular to the feed direction.

7. The image forming apparatus according to claim 1, wherein the image forming unit ejects ink toward the platen.

8. The image forming apparatus according to claim 7, wherein:

the image forming unit includes a nozzle surface facing the platen for ejecting ink; and the suction ports on at least one of the upstream side and the down stream side in the feed direction are provided in a region of the platen, which is outside a region where the platen faces the nozzle surface.

9. The image forming apparatus according to claim 8, wherein:

the image forming unit includes a recording head having the nozzle surface facing the platen; and the suction ports are provided in a region of the platen, which is outside a region where the platen faces the recording head.

10. The image forming apparatus according to claim 9, wherein the suction ports are provided in a region, which is outside a region where the recording head is moved by the carriage.

11. The image forming apparatus according to claim 1, wherein the platen includes an air chamber which communicates with the suction ports provided on at least one of the upstream and downstream sides of the platen.

12. The image forming apparatus according to claim 11, wherein a total area of the suction ports provided on the upstream side of the platen is equal to that of the suction ports provided on the downstream side of the platen.

13. The image forming apparatus according to claim 1, wherein the suction ports are formed at both downstream and upstream ends of the recesses.

14. An image forming apparatus comprising:

an image forming unit which forms an image on one surface of a printing medium;

a platen;

a feeding device which transports the printing medium in a feed direction along the platen while the other surface of the printing medium faces a surface of the platen; and a suction device which sucks air, wherein:

the platen includes:

first protrusions which protrude from the surface of the platen and extend in parallel with the feed direction and are arranged at predetermined intervals in a direction perpendicular to the feed direction;

recesses which are defined between adjacent ones of the first protrusions and extend in the feed direction;

second protrusions which protrude from the surface of the platen and are provided on downstream and upstream sides, respectively, in the feed direction with respect to an image forming region where the image forming unit forms an image, and extend in the direction perpendicular to the feed direction; and suction ports which are defined in a predetermined region in the vicinity of the second protrusions and at least one of downstream of the second protrusions, in a situation in which the second protrusions are located at the upstream side of the image forming region and upstream of the second protrusions, in a situation in which the second protrusions are located at the downstream side of the image forming region, and communicate with the suction device; and at least part of the second protrusions on the upstream side and the second protrusions on the downstream side are disposed in two rows in a staggered configuration.

15. The image forming apparatus according to claim 14, wherein each of second protrusions is connected to or adjacent to at least two of the first protrusions.

16. The image forming apparatus according to claim 14, wherein at least one of the recesses includes a slope which is formed between at least one of the first and second protrusions and the suction ports.

17. The image forming apparatus according to claim 14, wherein a height of each second protrusion, which corresponds to a position of each side edge of the printing medium in the direction perpendicular to the feed direction and is provided on the downstream side in the feed direction, is lower than those of the first protrusions or substantially equal to those of the recesses.

18. The image forming apparatus according to claim 14, wherein the first protrusions are arranged at such intervals that the interval on an end side of the platen is wider than that on a central portion of the platen in the direction perpendicular to the feed direction.

19. The image forming apparatus according to claim 14, wherein the image forming unit ejects ink toward the platen.

20. The image forming apparatus according to claim 19, wherein:

the image forming unit includes a nozzle surface facing the platen for ejecting ink; and the suction ports on at least one of the upstream side and the down stream side in the feed direction are provided in a region of the platen, which is outside a region where the platen faces the nozzle surface.

21. The image forming apparatus according to claim 20, wherein:

the image forming unit includes a recording head having the nozzle surface facing the platen; and the suction ports are provided in a region of the platen, which is outside a region where the platen faces the recording head.

22. The image forming apparatus according to claim 21, wherein:

the image forming unit includes a carriage which moves forward and backward the recording head in a predetermined direction; and the suction ports are provided outside a region where the carriage has substantially the same height as the nozzle surface of the recording head.

23. The image forming apparatus according to claim 22, wherein the suction ports are provided in a region, which is outside a region where the recording head is moved by the carriage.

24. The image forming apparatus according to claim 14, wherein the platen includes an air chamber which communicates with the suction ports provided on at least one of the upstream and downstream sides of the platen.

25. The image forming apparatus according to claim 24, wherein a total area of the suction ports provided on the upstream side of the platen is equal to that of the suction ports provided on the downstream side of the platen.

26. An image forming apparatus comprising an image forming unit which forms an image on one surface of a printing medium;

a platen;

a feeding device which transports the printing medium in a feed direction along the platen while the other surface of the printing medium faces a surface of the platen; and a suction device which sucks air, wherein:

the platen includes:

first protrusions which protrude from the surface of the platen and extend in parallel with the feed direction and are arranged at predetermined intervals in a direction perpendicular to the feed direction;

recesses which are defined between adjacent ones of the first protrusions and extend in the feed direction;

second protrusions which protrude from the surface of the platen and are provided on at least one of upstream side and downstream side in the feed direction with respect to an image forming region where the image forming unit forms an image, and extend in the direction perpendicular to the feed direction; and suction ports which are defined in a predetermined region of at least one of the recesses in the vicinity of the second protrusions and in another region of at least one of the recesses distant from the predetermined region in the feed direction, are defined at least one of downstream of the second protrusions, in a situation in which the second protrusions are located at the upstream side of the image forming region, and upstream of the second protrusions in a situation in which the second protrusions are located at the downstream side of the image forming region, and communicate with the suction device, wherein the image forming unit includes a carriage which moves the recording head forward and backward the recording head in a predetermined direction; and the suction ports are provided outside a region where the carriage has substantially the same height as the nozzle surface of the recording head.

27. The image forming apparatus according to claim 26, wherein each of second protrusions is connected to or adjacent to at least two of the first protrusions.

28. The image forming apparatus according to claim 26, wherein at least one of the recesses includes a slope which is formed between at least one of the first and second protrusions and the suction ports.

29. The image forming apparatus according to claim 26, wherein a height of each second protrusion, which corresponds to a position of each side edge of the printing medium in the direction perpendicular to the feed direction and is provided on the downstream side in the feed direction, is lower than those of the first protrusions or substantially equal to those of the recesses.

30. The image forming apparatus according to claim 26, wherein the first protrusions are arranged at such intervals that the interval on an end side of the platen is wider than that on a central portion of the platen in the direction perpendicular to the feed direction.

31. The image forming apparatus according to claim 26, wherein the image forming unit ejects ink toward the platen.

32. The image forming apparatus according to claim 31, wherein:

the image forming unit includes a nozzle surface facing the platen for ejecting ink; and the suction ports on at least one of the upstream side and the down stream side in the feed direction are provided in a region of the platen, which is outside a region where the platen faces the nozzle surface.

33. The image forming apparatus according to claim 32, wherein:

the image forming unit includes a recording head having the nozzle surface facing the platen; and the suction ports are provided in a region of the platen, which is outside a region where the platen faces the recording head.

34. The image forming apparatus according to claim 33, wherein the suction ports are provided in a region, which is outside a region where the recording head is moved by the carriage.

35. The image forming apparatus according to claim 26, wherein the platen includes an air chamber which communicates with the suction ports provided on at least one of the upstream and downstream sides of the platen.

36. The image forming apparatus according to claim 35, wherein a total area of the suction ports provided on the upstream side of the platen is equal to that of the suction ports provided on the downstream side of the platen.

37. The image forming apparatus according to claim 26, wherein the predetermined region is located at an end of the recesses with respect to the feed direction.

38. An image forming apparatus comprising:

an image forming unit which forms an image on one surface of a printing medium;

a platen;

a feeding device which transports the printing medium in a feed direction along the platen while the other surface of the printing medium faces a surface of the platen; and a suction device which sucks air, wherein:

the platen includes:

a plurality of paper receiving surfaces which are provided on the surface of the platen and extend in parallel with the feed direction and are provided at predetermined intervals in a direction perpendicular to the feed direction;

recesses which are defined between adjacent ones of the paper receiving surfaces and extend in the feed direction;

estrange portions which are provided on one of upstream side and downstream side of at least a part of the recesses in the feed direction and estrange the printing medium and the recesses; and suction ports which are defined on the other of the upstream side and the downstream side in the feed direction and communicate with the suction device, wherein the image forming unit includes a carriage which moves the recording head forward and backward in a predetermined direction; and the suction ports are provided outside a region where the carriage has substantially the same height as the nozzle surface of the recording head.

39. The image forming apparatus according to claim 38, wherein the suction ports are defined in a predetermined region located at an end of the recesses with respect to the feed direction.

40. A platen comprising:

a plurality of paper receiving surfaces which are provided on a surface of the platen and extend in parallel with a predetermined direction and are provided at predetermined intervals in a direction perpendicular to the predetermined direction;

recesses which are defined between adjacent ones of the paper receiving surfaces and extend in the predetermined direction;

estrange portions which are provided on at least one of upstream side and downstream side of at least a part of the recesses in the predetermined direction and estrange the printing medium and the recesses; and suction ports which are defined on at least one of the upstream side and the downstream side in the feed direction and on a surface of at least a part of the recesses, wherein the image forming unit includes a carriage which moves the recording head forward and backward in a predetermined direction; and the suction ports are provided outside a region where the carriage has substantially the same height as the nozzle surface of the recording head.

41. The image forming apparatus according to claim 40, wherein the suction ports are defined in a predetermined region located at an end of the recesses with respect to the feed direction.

42. An image forming apparatus comprising:

an image forming unit which forms an image on one surface of a printing medium;

a platen;

a feeding device which transports the printing medium in a feed direction along the platen while the other surface of the printing medium faces a surface of the platen; and a suction device which sucks air, wherein:

the platen includes:

first protrusions which protrude from the surface of the platen and extend in parallel with the feed direction and are arranged at predetermined intervals in a direction perpendicular to the feed direction;

recesses which are defined between adjacent ones of the first protrusions and extend in the feed direction;

second protrusions which protrude from the surface of the platen and are provided on downstream and upstream sides, respectively, in the feed direction with respect to an image forming region where the image forming unit forms an image, and extend in the direction perpendicular to the feed direction; and suction ports which are defined on both the downstream and upstream sides, respectively, in the feed direction with respect to the image forming region in each of recesses surrounded by the adjacent ones of the first protrusions and the second protrusions on the upstream side and the downstream side, and communicate with the suction device, wherein the first protrusions are arranged at such intervals that the interval on an end side of the platen is wider than that on a central portion of the platen in the direction perpendicular to the feed direction.

43. An image forming apparatus comprising:

an image forming unit which forms an image on one surface of a printing medium;

a platen;

a feeding device which transports the printing medium in a feed direction along the platen while the other surface of the printing medium faces a surface of the platen; and a suction device which sucks air, wherein:

the platen includes:

first protrusions which protrude from the surface of the platen and extend in parallel with the feed direction and are arranged at predetermined intervals in a direction perpendicular to the feed direction;

recesses which are defined between adjacent ones of the first protrusions and extend in the feed direction;

second protrusions which protrude from the surface of the platen and are provided on at least one of upstream side and downstream side in the feed direction with respect to an image forming region where the image forming unit forms an image, and extend in the direction perpendicular to the feed direction; and suction ports which are defined in a predetermined region of at least one of the recesses in the vicinity of the second protrusions and in another region of at least one of the recesses distant from the predetermined region in the feed direction, are defined at least one of downstream of the second protrusions, in a situation in which the second protrusions are located at the upstream side of the image forming region, and upstream of the second protrusions, in a situation in which the second protrusions are located at the downstream side of the image forming region, and communicate with the suction device, wherein the first protrusions are arranged at such intervals that the interval on an end side of the platen is wider than that on a central portion of the platen in the direction perpendicular to the feed direction.

* * * * *